United States Patent [19]

Kankaanpaa

[11] 3,997,390

[45] Dec. 14, 1976

[54] TWIN-WIRE PAPER MACHINE AND METHOD FOR OPERATING THE SAME

[75] Inventor: Matti Kankaanpaa, Tapiola, Finland

[73] Assignee: Valmet Oy, Helsinki, Finland

[22] Filed: July 31, 1974

[21] Appl. No.: 493,704

Related U.S. Application Data

[63] Continuation-in-part of Ser. No. 344,260, March 23, 1973, Pat. No. 3,846,232.

[52] U.S. Cl. ..... 162/132; 162/199; 162/203; 162/212; 162/217; 162/273; 162/303; 162/347

[51] Int. Cl.[2] ..... D21F 1/00

[58] Field of Search ..... 162/132, 203, 211, 212, 162/217, 300, 301, 303, 304, 336, 344, 347, 351, 364, 369, 370, DIG. 7, 199, 273

[56] References Cited

UNITED STATES PATENTS

| | | | |
|---|---|---|---|
| 2,911,039 | 11/1959 | Hornbostel et al. | 162/303 |
| 3,578,560 | 5/1971 | Notbohm et al. | 162/344 |
| 3,582,467 | 6/1971 | Gustafson et al. | 162/303 |
| 3,726,758 | 4/1973 | Parker et al. | 162/203 X |
| 3,855,057 | 12/1974 | Hill | 162/301 |
| 3,867,252 | 2/1975 | Skrabak et al. | 162/203 X |
| 3,915,791 | 10/1975 | Langdon | 162/132 |

*Primary Examiner*—S. Leon Bashore
*Assistant Examiner*—Richard V. Fisher
*Attorney, Agent, or Firm*—Steinberg and Blake

[57] ABSTRACT

A twin-wire paper machine and method for operating the same. The machine includes an endless carrier wire and an endless pressure wire respectively extending along closed separate loops and having common run portions between which a web is compressed while travelling from an inlet end to an outlet end of the common run portions. A pair of guide rolls are respectively situated in the loops and engage the wires in advance of the inlet end of the common run portions to direct the wires respectively along converging paths toward the inlet end of the common run portions, these converging wire paths forming an entrance region where a headbox is located for directing a stock jet through a slice defined by a pair of lips of the headbox. A forming board engages one of the wires between the inlet end of the common run portions and the guide roll which engages this one wire, and the stock jet is directed toward this one wire and the forming board engaging the same. The headbox, one of the lips thereof, and the combination of the forming board and the guide roll which engages the same wire as the forming board respectively form three units at least one of which is adjusted, by suitable adjusting mechanism, for determining the angle of the stock jet issuing from the headbox.

20 Claims, 2 Drawing Figures

TWIN-WIRE PAPER MACHINE AND METHOD FOR OPERATING THE SAME

CROSS REFERENCE TO RELATED APPLICATION

This application is a continuation-in-part of copending application Serial No. 344,260, filed March 23, 1973, now U.S. Pat. No. 3,846,232.

BACKGROUND OF THE INVENTION

The present invention relates to paper-manufacturing machines and to methods for operating such machines.

In particular, the present invention relates to twin-wire paper machines and methods for operating the same.

Machines of this latter type conventionally include a pair of endless wires which respectively extend along closed loops, the wires having common run portions between which the web is compressed and formed while travelling from an inlet end to an outlet end of the common run portions.

The most commonly used type of paper-manufacturing machine is the fourdrinier machine which has a single wire guided so as to have an upper horizontal planar portion on which the web is formed. The forming of a continuous paper web in such a machine takes place on the substantially horizontal wire while the pulp slurry, or paper-fiber stock, is fed onto the wire from a headbox in the form of a dilute suspension in which water is present in a quantity of approximately 100–400 times the quantity of fibers. The water which is present in the fiber suspension is removed, or filtered off, through the wire in one direction, namely downwardly, partly due to gravity and partly by means of suction created by units which support the wire. The pulp stock is supplied to the fourdrinier from the headbox which has at a lower part adjacent the wire a narrow slice the length of which equals the width of the wire. From the slice the fiber suspension is discharged onto the wire in the form of a relatively coherent jet. The headbox is located at the starting end of the upper horizontal run of the wire and for the most part above the level of the wire where the web is formed.

The slice of the headbox is formed between upper and lower lips, and generally the upper lip is adjustable with respect to the lower lip so that it is possible in this way to regulate the angle at which the stock jet is directed toward the wire. The velocity of the stock jet with respect to the speed of the wire is also adjustable. Also a forming board which is customarily located beneath the wire between the breast roll and the first table roll is adjusted to determine the manner in which dewatering takes place during the initial stage of web formation, i.e. through a length of 50–150 cm subsequent to the slice.

In recent years there have been developments in connection with twin-wire paper machines which differ from fourdriniers in that the web is formed entirely between a pair of wires with dewatering taking place simultaneously in two opposed directions through both of the wires. This type of machine and principle of operation adds considerably to the dewatering rate. With such machines the area in which formation of the web takes place is generally curved with its direction deviating considerably from a horizontal plane. As a result of its efficient dewatering action, the twin-wire type of machine is considerably shorter than fourdrinier machines.

With known twin-wire machines the pulp stock is supplied by directing the stock jet from the headbox to the junction of the two wires at the inlet end of the common run portions thereof so that the stock jet enters at a converging entrance region where the wires converge toward each other to form a throat leading to the inlet end of the common run portions of the wires. The direction of the jet is maintained symmetrical with respect to the converging portions of the wires which travel toward the inlet end of the common run portions thereof, with the result that dewatering takes place rapidly in two opposed directions through both wires.

While the above mode of feeding of the stock is without doubt efficient with respect to dewatering, nevertheless it involves, as compared with a fourdrinier, certain drawbacks as pointed out below.

In order to better understand the present invention and the problems solved thereby, certain theoretical factors in connection with formation of a paper web on a fourdrinier wire section are reviewed.

The paper produced on a paper machine always has a certain lack of homogeneity either with respect to properties which are visually observed or, for example, with respect to the strength characteristics of the paper. This lack of homogeneity partly results from the fact that the paper fibers are relatively long as compared with their thickness. As a result the fibers suspended in water become entangled, forming aggregates known as flocs which are visible as relatively dark spots in the finished paper when the latter is viewed against light. The presence of the flocs in paper is undesirable. Also as a result of the fact that the fibers are relatively long as compared to their thickness, the pulp suspension flows through the slice in such a way that the fibers tend to become oriented in the direction of flow and thus these fibers tend to remain oriented in the formed web longitudinally with respect to the long axis of the paper machine, which is to say the fibers tend to extend in the direction of web travel. This particular orientation of the fibers has a large influence on the properties of the strength of the paper as well as on the behavior of the paper with regard to water and water vapor.

Paper which has its fibers oriented in a pronounced manner in the direction of web travel has a much higher tensile strength longitudinally, or in the machine direction, than in the cross-machine or transverse direction. In some cases such a high strength in the longitudinal direction is desirable, as when manufacturing spinning paper from which paper string is made. However, in most cases it is of advantage to maintain the tensile ratio of the paper, which is the ratio of the strengths thereof longitudinally and transversely, as low as possible.

The fiber orientation becomes clearly apparent from the behavior of the paper with respect to water and water vapor. When dry paper is transported, for example, into a humid storage area, it begins to curl as a result of the hygroscopic nature of the fibers as well as to the fact that the fibers swell to a greater extent transversely, as compared to any longitudinal swelling. Thus, where the paper has been manufactured in such a way that the fibers are primarily oriented in the direction of web travel, expansion due to humid conditions takes place in a much more pronounced manner transversely of the web, when considered with respect to the direction of machine travel, so that curling undesirably occurs.

It is therefore apparent that paper may be nonhomogeneous in two different ways. Flocs, which are created in the suspension and present in the paper formation, are immediately apparent to the eye. Anisotropy, or the difference in the characteristics of the paper longitudinally as compared with its characteristics transversely, is a phenomenon which may become visible under certain circumstances as when the paper curls in the manner described above. For the most part, however, this anisotropy is demonstrable by laboratory tests such as tests for determining strength properties. It is possible to influence both the presence of flocs as well as web formation and anisotropy by controlling the interaction between the headbox and the wire which receives the stock jet therefrom. The most important variables which should be controlled in this connection are:

1. the relationship between the velocity of discharge of the stock jet and the speed of the wire,
2. the angle with which the stock jet impinges on the wire, and
3. the rate at which water is removed from the suspension which is deposited on the wire.

These factors affect not only the orientation of the fibers but also the web formation. In addition it is to be noted that if it is desired to reduce the presence of flocs and improve web formation, it is necessary to operate under conditions which will result in relatively pronounced fiber orientation. The paper-maker must choose operating conditions at the paper machine which will provide a compromise between those factors which will reduce fiber orientation and those factors which will improve web formation.

By way of example it should be noted that as a rule fiber orientation is least pronounced when the wire speed approximately equals the velocity with which the stock jet is discharged onto the wire. On the other hand, the best possible web formation requires the wire to travel at a speed somewhat higher than the jet velocity.

In addition, it is usually advisable, in order to prevent pronounced fiber orientation, to provide for removal of water from the deposited fiber suspension at a comparatively slow rate during the first few meters of web formation immediately subsequent to issue of the jet from the headbox. The dewatering process is influenced, for example, by regulating the angle at which the stock jet impinges on the wire. The smaller this angle the slower the passage of water through the wire. The magnitude of this angle can be changed most simply by adjusting the position with respect to each other of the lips of the headbox which define the slice thereof.

However, slow dewatering impairs web formation in many cases.

Thus, there are no generally valid rules with respect to the influence of the above process variables on the characteristics of the paper. Optimization of paper machine operations depends, for example, on the fiber material which is utilized, the consistency of stock, and the machine speed, as well as, naturally, on the type and basis weight of the paper which is manufactured.

The achievement of the best results requires extensive experimentation and a paper machine which has the greatest possible versatility in the adjustment of the components thereof.

While it is indeed possible with a fourdrinier to influence the fiber orientation during the initial 50–150 cm region of web formation on the wire beyond the slice of the headbox in the direction of web travel, such control of the fiber arrangement is not possible with twin-wire machines where it has been noted from observation and experience that when the pulp jet is directed into the throat to the inlet end of the common wire portions the arrangement and orientation of the fibers in the web which is produced is the same as in the jet itself. Further influence on fiber orientation is no longer possible with a twin-wire machine.

Of course, it is recognized that many headbox designs presently used in twin wire machines deliver the pulp suspension into the gap between the wires in such condition that there is no particular fiber orientation in the jet and as a result the web which is formed has no pronounced fiber orientation. Nevertheless, as has been indicated above, there are certain types of paper which in view of their intended use should have a predetermined fiber orientation. For example orientation of the fibers longitudinally, in the direction of web travel, is highly favorable for certain intended uses of paper. In principle, orientation of the fibers may be achieved by discharging the stock from the slice at a speed smaller than the speed of travel of the wire on which the web is formed, in which case the combing effect of the wire which occurs at the start of the web formation results in fiber orientation. However with twin-wire machines no such combing effect can be produced because the arrangement of the fibers in the stock jet is "frozen" between the wires.

Furthermore, with conventional twin-wire machines it is not possible to adjust to a desired extent the angle at which the stock jet impinges on the wire or wires, so that as a result of this latter deficiency one possible way of controlling web structure is lost.

SUMMARY OF THE INVENTION

It is accordingly a primary object of the present invention to provide a twin-wire paper machine and operating method therefor capable of influencing the above variables in a highly advantageous manner so as to be able to achieve desired fiber arrangement in the paper sheet.

Thus, it is an object of the present invention to provide a method and machine rendering it possible to adjust various operating factors and components in such a way that fiber orientation can be controlled to an extent far greater than has heretofore been possible with twin wire machines.

In particular, it is an object of the invention to provide a method and structure which make it possible to adjust the angle of the stock jet with respect to the wire which receives the stock jet.

Furthermore, in order to control the product achieved from the machine, it is an object of the invention to provide a method and apparatus capable of regulating the angle of the entrance zone or throat leading to the inlet end of the common run portions of the wires between which the web is compressed during formation thereof.

In addition, it is an object of the present invention to provide a method and structure according to which it becomes possible to control the properties of the paper which is manufactured by combining together different types of pulp stock.

Thus, in this latter connection it is in particular an object of the present invention to provide a method and apparatus which make it possible to control the characteristics of the paper which is manufactured by combining together initially deposited webs of different types.

Also, it is an object of the invention to provide substantially equal dewatering in both opposed directions through the pair of twin wires.

According to one of the features of the present invention a forming board is situated against one or both of the wires between the inlet end of the common run portions thereof, where a forming roll is located, and guide rolls which guide the wires respectively along converging paths to the inlet end of the common run portions so as to define the entrance region or throat, with the stock being supplied from the headbox slice onto the wire portion which is next to the forming board. In addition it is possible in accordance with the invention to adjust the angle of the stock jet issuing from the headbox with respect to the wire which receives the jet.

Thus, with the present invention the rate of dewatering, and as a result the characteristics of web formation and fiber orientation, is influenced by placing next to the wire where the stock jet impinges thereon a forming board having openings through which dewatering takes place. This latter type of construction is selected in accordance with experience gained as to how to achieve the best results with different types of pulp stock. The forming board is provided next to the wire with a cover which may be foraminous or provided with suitable slits, depending upon the desired particular proportion of the free area of the openings to the total cover area of the forming board. It is also possible to adjust the dewatering rate by throttling the cross-section of the water-draining duct which is connected with the forming board or, in contrast, by operatively connecting with the interior of the hollow forming board an appropriate suction device.

In accordance with the invention dewatering is also influenced by adjusting the angle at which the stock jet impinges on the wire. This angle is adjusted in a relatively simple manner by adjusting the mutual relationship between the lips of the headbox which define the discharge slice thereof. The primary direction of the issuing stock jet is obtained by swivelling the entire headbox with respect to the wire.

Thus, with features as set forth above it is possible to achieve with the present invention an improvement in the delivery of the pulp stock to the wire or wires of a twin-wire machine so that it is possible to retain those adjusting possibilities and those features which are already used in connection with fourdriniers and to which the papermaker is accustomed in order to influence paper properties through control of web formation and fiber orientation.

With the present invention it is possible to achieve the desired results by delivering the pulp stock either to the carrier wire or to the pressure wire beyond which the carrier wire transports the web after it is formed during compression between the common run portions of the wires. It is additionally possible, however, to supply two stock jets from a pair of headboxes simultaneously to both wires, and in this case the compositions of the two different pulp stocks may be different so as to provide the additional possibility of influencing the quality and characteristics of the paper in an entirely new manner.

Thus, in accordance with the present invention the twin-wire paper machine includes an endless carrier wire and an endless pressure wire respectively extending along separate closed loops and having coextensive common run portions between which a web is compressed during formation thereof while travelling from an inlet end of the common run portions to an outlet end thereof, the carrier wire carrying the web beyond the outlet end of the common run portions. A forming roll means is situated within the loop of the carrier wire at the inlet end of the common run portions. A pair of guide rolls are respectively situated within the loops and respectively engage the wires in advance of the inlet end for directing the wires toward the inlet end respectively along converging paths which define between themselves an entrance region to the inlet end where the forming roll means is located. A forming board means is situated in one of the loops and engages one of the wires between the inlet end and the guide roll which engages this one wire. A headbox means is situated at least partly at the entrance region and has a pair of lips which define between themselves a slice through which the headbox means directs a stock jet toward the wire which engages the forming board means. This headbox means, at least one of the lips thereof, and the combination of the forming board means and the guide roll which engages the same wire as the forming board means respectively form three units at least one of which is adjustable for adjusting the angle of the jet with respect to the wire on which the jet impinges. According to the invention an adjusting mmeans is provided for adjusting this one unit so as to determine the latter angle while according to the method of the invention this one unit is adjusted so as to determine the angle of the jet with respect to the wire which receive the same.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
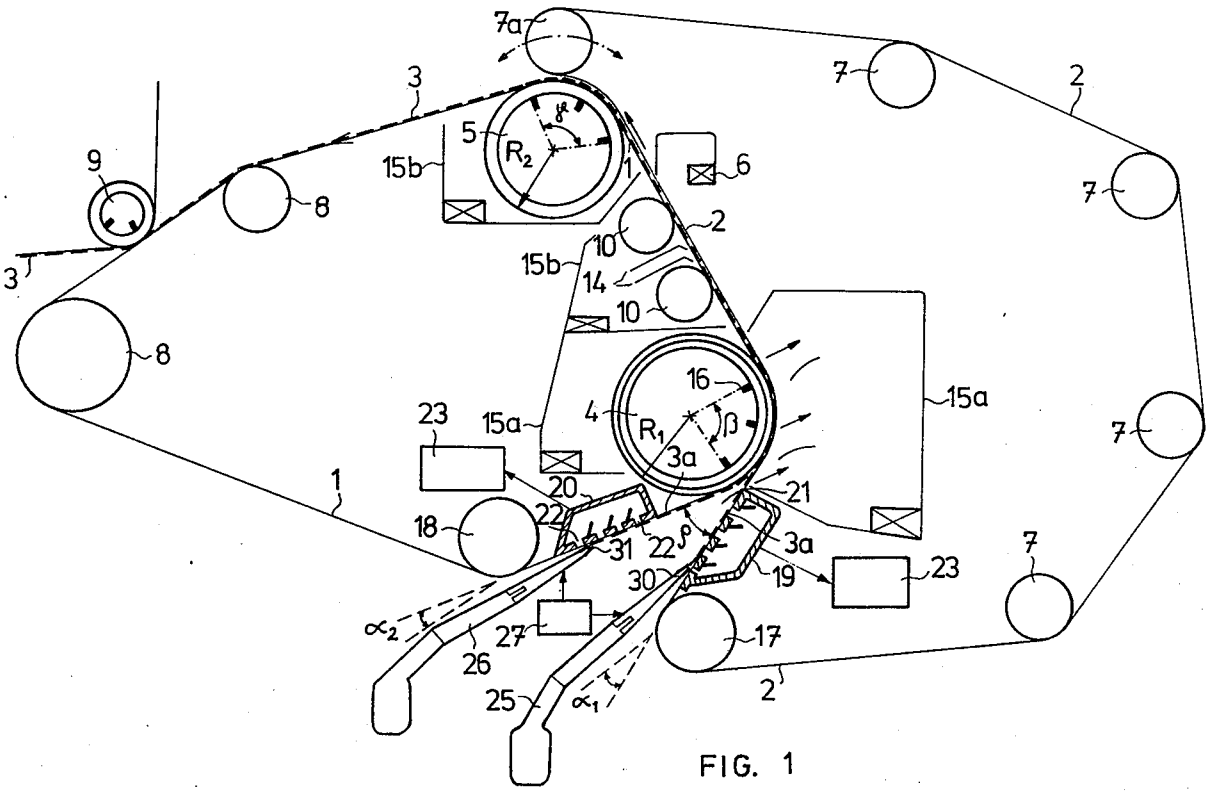
FIG. 1 is a schematic illustration of one possible method and apparatus according to the present invention.

Referring first to FIG. 1, the twin-wire paper machine schematically illustrated therein includes an endless carrier wire 1 and an endless pressure wire 2. It is to be understood that the carrier wire 1 is the wire on which the paper web remains after compression of the web, during formation thereof, between common run portions of the wires as described below. The web which is thus transported by the carrier wire beyond the common run portions of the wires is picked up in the conventional manner for further transportation to the press section.

Thus, the pressure wire is the wire which serves to compress the paper web during formation thereof against the carrier wire at the common run portions of the two wires.

Within the closed loop defined by the carrier wire 1 there are a pair of dewatering rolls 4 and 5 connected to an unillustrated vacuum system. The first of these rolls, considered in the direction of web travel, is the forming roll means 4. At the region of the forming roll means 4 water escapes from the pulp partly as a result of the vacuum prevailing in the interior of the forming roll means and partly in the opposite direction as a result of centrifugal force. The forming roll means 4 corresponds to a conventional suction breast roll and has in its interior a schematically illustrated suction box structure 16 defining two suction compartments $\beta$ in which vacuum can be regulated in a well known manner. In the event that the dewatering resulting from centrifugal force tends to produce an undesirable one-sided paper web, then, in accordance with a further feature of the invention, the pressure wire 2 is chosen so as to have a mesh which does not have the coarseness of the mesh of the carrier wire 1. Thus in this case the wire 2 will have a finer mesh than the wire 1 with the mesh of the wire 2 providing at the intersections of the wire spaces small enough so that it is possible to reduce loss of the fine fiber fraction together with water drawn from the pulp web.

As is apparent from FIG. 1, the wires 1 and 2 have common run portions where they are coextensive with each other with these common run portions having an inlet end at the location where the forming roll means 4 is situated in the loop of the carrier wire 1. These common run portions of the wires 1 and 2 extend along a straight or slightly curved path to the couch roll 5 where the outlet end of the common run portions of the wires 1 and 2 is located. Curvature of the path defined by the common run portions of the wires 1 and 2 enables the wires 1 and 2 to remain together throughout their common run portions without requiring any excessive tension in the wire 2 in order to achieve this result. The maintenance of the common run portions of the wires 1 and 2 directly next to each other may be aided by utilizing a suitable foil structure in the loop of pressure wire 2, thus exerting a pressure on the latter wire and also serving as a dewatering means. In order to provide a curvature to the path travelled by the common run portions of the wires, wire guide means 10, 14 may be situated between the suction rolls 4 and 5. This wire guide means can include either rotary wire-guide rolls 10 or one or more narrow foils 14 which exert a minimum abrasive action on the wire 1.

In the same way as the suction breast roll 4, the couch roll 5 has in its interior suction boxes providing a pair of suction compartments situated at the sector $\alpha$. It will be noted that the forming roll means 4 has the radius $R_1$ while the couch roll 5 has the radius $R_2$.

At the outlet end of the common run portions of the wires 1 and 2, where the couch roll 5 is situated, the pressure wire 2 is guided around a roll 7*a* which serves to press the fiber web 3, which is formed between the wires 1 and 2, against the suction zone of the couch roll 5 in order to enhance dewatering. The position of the roll 7*a* and its pressure against the couch roll 5 are adjustable. In one of the end positions of adjustment of the roll 7*a*, the pressure wire 2 can be extended so as to cover the entire suction zone of the couch roll 5. The loop of the carrier wire 1 has a relatively extended portion just beyond the roll 7*a* which may extend in a horizontal plane but which is shown as inclined downwardly somewhat toward the left, as viewed in FIG. 1, so as to constitute a portion of the carrier wire 1 which transports the web 3 forwardly beyond the outlet end of the common run portions of the wires 1 and 2. It is from this portion of the wire 1 that the web 3 is picked up by the suction roll 9.

The water which escapes from the web during formation thereof at the region of the forming roll means 4 is collected in savealls 15*a* and conducted therefrom to the intake side of unillustrated mixing pumps which supply the headbox means 25 and/or the headbox means 26, so that this water retrieved from the savealls 15*a* can be used as dilution water. At the region of the wire guide means 10, 14, described above, as well as at the region of an additional dewatering means 6 situated in the loop of the pressure wire 2, and at the region of the couch roll 5 in the loop of the carrier wire 1, the water which escapes from the web has a lesser fiber content than the water collected by the savealls 15*a*, and this water which results from dewatering occurring subsequent to the savealls 15*a* is collected in savealls 15*b* to be conveyed therefrom to a location of the water system where the liquid has a lesser fiber content.

In the example which is illustrated in FIG. 1, pulp stock is supplied to the wires from two headbox means 25 and 26. The headbox means 25 supplies pulp stock to the pressure wire 2 at a location where a forming board means 19 has been situated against the wire 2 within the loop thereof on that part of the wire 2 which travels from the guide roll 17 to the inlet end of the common run portions where the forming roll means 4 is situated. In a corresponding manner, the second headbox means 26 supplies pulp stock to the carrier wire 1 at a point where the wire 1 engages a forming board means 20 situated in the loop of the wire 1 between a guide roll 18 and the inlet end of the common run portions of the wires where the forming roll means 4 is situated. Thus, the guide rolls 17 and 18 serve to guide the wires 2 and 1, respectively, along converging paths to the inlet end of the common run portions of the wires, these converging paths of the wires defining the entrance region or throat which has the angle $\rho$ indicated in FIG. 1, and it is apparent that the headbox means 25 and the headbox means 26 are partly located at this entrance region. As is apparent from FIG. 1, the forming board means 19 and the forming board means 20 are in the form of suction boxes having outer covers which directly engage the wires and against which the wires are respectively urged. These covers may be foraminous or may be formed with suitable slits. However, the forming board means 19 may have at its lower side, in some cases, a solid cover. The details of the forming board means 19 are clearly shown in FIG. 2.

The initial dewatering of the pair of stock jets deposited respectively from the headbox means 25 and the headbox means 26 onto the wires 2 and 1, respectively, takes place at the pair of forming board means 19 and 20, respectively, and the separately deposited jets form, as they travel toward the inlet end of the common run portions of the wires, separate preliminary webs which are joined together to form a single web 3 which is compressed between the common run portions of the wires 1 and 2, this joining together of these preliminary webs taking place at the suction zone $\beta$ defined by the suction box structure 16 of the forming roll means 4, this suction box 16 having suitable foils. At this location, namely at the suction zone $\beta$, dewatering takes place partly as a result of suction directly into the interior of the forming roll means 4 and partly as a result of centrifugal force in an opposite direction outwardly away from the forming roll means 4 into the right saveall 15*a* shown in FIG. 1.

Figure 2:
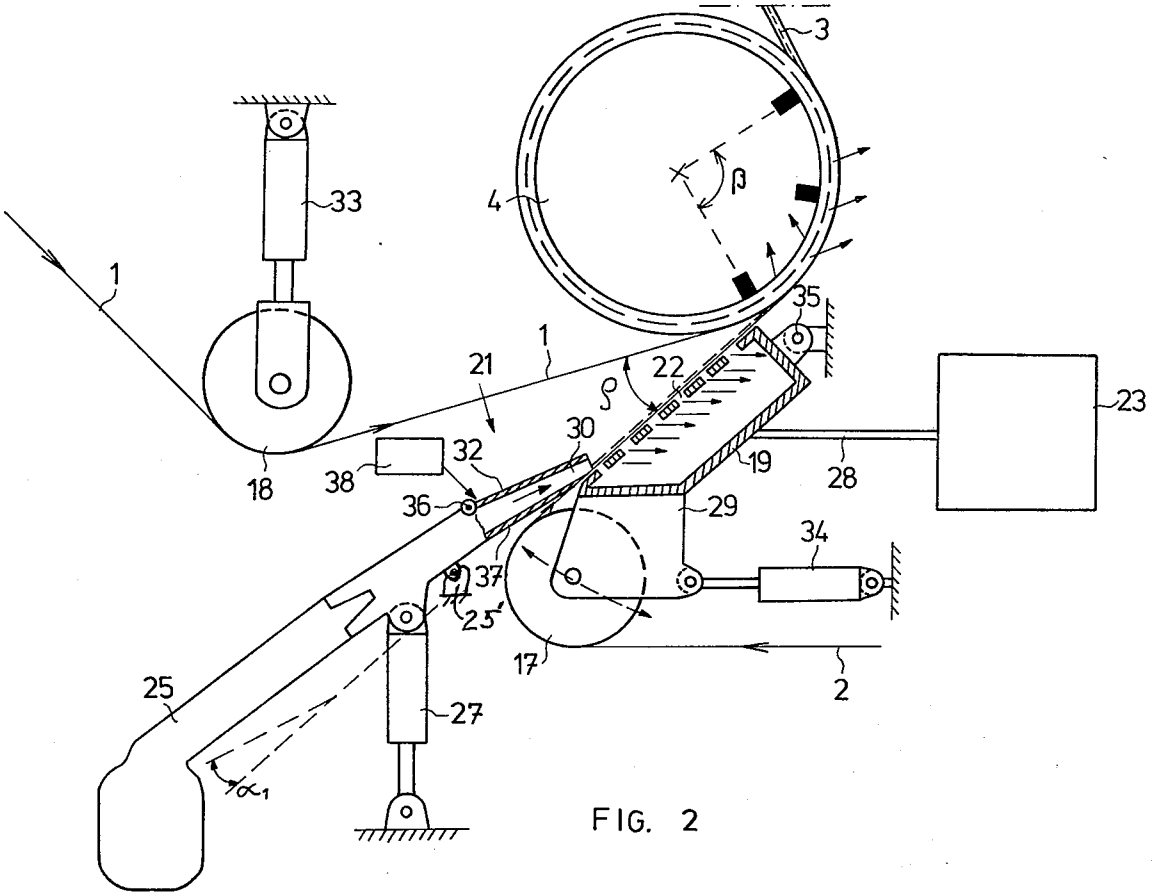
FIG. 2 shows fragmentarily and schematically, at a scale which is enlarged as compared to FIG. 1, a number of details which may be incorporated into FIG. 1 while FIG. 2 at the same time illustrates a different embodiment of the invention.

The web formation at the region of the forming boards 19 and 20 can be regulated by connecting the space within the hollow forming boards 19 and 20 to a source of suction such as one or more air pumps 23 serving to produce a vacuum which may be adjusted within predetermined limits. FIG. 1 schematically shows a pair of suction means 23 but it is to be understood that if desired the forming boards 19 and 20 may be connected to a common suction means 23. The connection of the suction means 23 to the hollow interior of the forming board 19 is shown in FIG. 2 as taking place through a flexible conduit or tube 28. In FIGS. 1 and 2 angles $\alpha_1$ and $\alpha_2$ have been indicated to designate the angles respectively formed by the principal directions of flow of the stock jets issuing from the headboxes 25 and 26 and the respective wires 2 and 1 on which the jets respectively impinge.

It is possible, furthermore, to influence the dewatering by adjusting these angles $\alpha_1$ and/or $\alpha_2$. The larger the latter angle the greater the tendency for the water to escape in the region of the forming board means 19, 20 through the wires 2, 1 respectively. These angles may be adjusted by swivelling the entire headbox 25 or 26 with respect to the wire 2 or 1, respectively. For this purpose the headboxes 25 and 26 are mounted on suitable supports so as to be swingable about predetermined horizontal axes, and a power means such as suitable hydraulic cylinders 27 are schematically indicated as operatively connected with the headboxes 25 and 26 to form an adjusting means for adjusting these headboxes so as to adjust the angles $\alpha_1$ and $\alpha_2$. FIG. 2 shows in detail how the power means 27 may take the form of a suitable hydraulic piston-and-cylinder assembly pivotally connected to the headbox 25 which is supported for swinging movement about a horizontal axis in any suitable way, as by the schematically indicated supporting structure 25', so that in this way it is possible to swivel the entire headbox for adjusting the angle $\alpha_1$. In the same way it is possible to adjust the entire headbox 26 so as to adjust the angle $\alpha_2$.

However, a relatively simple means for adjusting these angles $\alpha_1$ and $\alpha_2$ may be provided by adjusting with respect to each other the upper and/or lower lip of each headbox, these lips of each headbox defining the slice thereof through which the stock jet issues. This feature is described in greater detail below in connection with FIG. 2.

As is apparent from FIG. 1, the structure includes a number of guide rolls 8 which serve to guide the carrier wire 1 along its closed loop from the couch roll 5 to the guide roll 18, as well as a number of guide rolls 7 which serve to guide the pressure wire 2 from the roll 7*a* to the guide roll 17. It will be noted that FIG. 1 also illustrates schematically the preliminary web portions 3*a* formed by the pair of stock jets which are initially deposited on the wires 1 and 2 at the entrance region 21, these preliminary web portions 3*a* combining to form the web 3 in the manner described above. FIG. 1 also illustrates the slits 22 which are in the cover of the forming board means 20 which engages the wire 1. Also it will be noted that FIG. 1 indicates the slices 30 and 31 of the headboxes 25 and 26.

Referring to FIG. 2, it will be seen that in this embodiment the guide rolls 17 and 18 may have their positions adjusted so as to adjust the entrance or throat angle between the converging portions of the wires 1 and 2. FIG. 2 illustrates the slits 22 of the forming board means 19, corresponding to the slits 22 shown for the forming board means 20 in FIG. 1. By adjusting the angle $\rho$ it is possible to influence the dewatering action as well as the tension in the wires 1 and 2 and the pressure exerted by these wires on the web 3 during formation of the latter between the common run portions of the wires 1 and 2. For this purpose the guide roll 17 and the forming board means 19 are connected to each other by a connecting means 29 which is in the form of a frame member fixed and projecting from the forming board means 19 and carrying the rotary guide roll 17. Thus the guide roll 17 and the forming board means 19 are formed into a single unit pivotally supported on the frame of the machine by a pivot structure 35 which is schematically illustrated. A power cylinder assembly 34 forms an adjusting means operatively connected to the unit formed by components 17 and 19, so as to adjust this unit with respect to the horizontal axis formed by the support structure 35. Therefore by way of the adjusting means 34 it is possible to adjust the unit 17, 19 so as to adjust not only the entrance or throat angle $\rho$ but also the angle $\alpha_1$ between the stock jet issuing from the headbox means 25 and the wire 2. A power means 33 similar to the power means 34 is operatively connected to the guide roll 18 for adjusting the position of the latter so that through this adjustment it is possible to adjust also the entrance or throat angle $\rho$.

As was pointed out above, the position of headbox 25 and at the same time the angle $\alpha_1$ between the jet issuing from the slice 30 and the wire 2 can be adjusted by the adjusting means formed by the power cylinder assembly 27. Moreover FIG. 2 shows how the slice 30 is defined between a lower lip 37 and an upper lip 32 of the headbox means 25. In the illustrated example the upper lip 32 is capable of being turned about the pivot 36 by which the upper lip 32 is connected to the remainder of the headbox. For this purpose the upper lip 32 is operatively connected with a power means 38 which forms the adjusting means for the upper lip 32. Thus, by adjusting the upper lip 32 with respect to the lower lip 37 it is also possible to adjust the angle $\alpha_1$ between the issuing stock jet and the wire 2.

It is apparent, therefore, that the headbox means 25, the lip 32 thereof, and the combination of the forming board means 19 and the guide roll 17 respectively form three units any one or all of which may be adjusted by the adjusting means 27, 38, 34, respectively, for adjusting the angle $\alpha_1$, while the adjusting means 34 is capable of acting through the unit 17, 19 not only to adjust the angle $\alpha_1$ but also to adjust the entrance or throat angle $\rho$.

As has been pointed out above, in the embodiments shown in FIGS. 1 and 2, the pressure wire 2 is selected so as to have a mesh which is denser or finer than the coarser mesh of the wire 1 so that in this way the loss of fine fibers together with the escaping water can be at least partly prevented at the wire 2 through the latter at the forming board means 19 and at the forming roll means 4 where the dewatering through the wire 2 results primarily from centrifugal force. By reason of the suction taking place at the sector $\beta$ in the forming roll means 4 and by means of the relatively wide or comparatively coarse mesh of the wire 1, in turn, dewatering through the latter may be increased.

The abrasive action of the forming boards 19 and 20 on the wires 2 and 1, respectively, is minimal because of the relatively large quantity of water escaping at the regions of the forming boards 19 and 20. This relatively large removal of water from the preliminarily deposited webs 3*a* effectively reduces friction between the wires 1 and 2 and the forming boards 20 and 19, respectively, at the surfaces of the latter which are respectively engaged by the wires 1 and 2.

As has been indicated above, with respect to the embodiment of FIG. 1, by providing different properties for the pulp stocks respectively delivered by the pair of headbox means 25 and 26 respectively to the wires 2 and 1, preliminary webs 3*a* of different properties can be united to form a common web which will have its characteristics determined by the combined preliminary webs 3*a*. Moreover, because with the invention it is possible to adjust either the angle $\alpha_1$ and/or the angle $\alpha_2$, it is possible to control the factor of fiber orientation so as to achieve for a twin-wire paper machine results which heretofore could only be achieved for a fourdrinier. Moreover, the possibility of controlling the dewatering, as describing above, further enables the qualities of the paper to be predetermined.

In accordance with the invention it is possible to achieve symmetrical dewatering action by controlling the operation so that an unequal dewatering in one direction at one location will be compensated by an unequal dewatering in an opposite direction at another location. Thus, as is apparent from the drawings, the first dewatering takes place at the wire where it is supported by the forming board while subsequently dewatering takes place at the forming roll 4. When the running speed of the paper machine is relatively high or when for any other reason there is a strong centrifugal force at the forming roll so that substantial dewatering takes place in a direction outwardly away from the forming roll, toward the right saveall 15*a* in FIG. 1, then the initial dewatering may be controlled so as to take place primarily at the carrier wire 1 for the web so that the initial dewatering may take place at the forming board 20, for example, in order to compensate for a strong centrifugal dewatering at the forming roll 4.

On the other hand, if there is a strong suction in the interior of the forming roll 4, so that a substantial dewatering takes place in the opposite direction toward the interior of the forming roll 4, then the adjustment of the dewatering is made in such a way that a substantial dewatering will take place at the forming board 19 of FIGS. 1 and 2 where the web engages the pressure wire, so as to compensate in this way for a strong dewatering toward the interior of the forming roll 4. In other words if the machine is operated in such a way that there is a strong centrifugal force at the forming roll 4, then a forming board and a suction action therethrough is provided at the carrier wire, while if there is a strong suction in the forming roll 4 so as to provide a considerable dewatering toward the interior of the forming roll 4, then a suction board will be applied to the pressure wire in order to compensate for the strong dewatering in the forming roll 4 by initially dewatering in the opposite direction through the pressure wire.

Thus, in the above manner it is possible to achieve a symmetrical dewatering by controlling the action that takes place successively along the path of the web.

What is claimed is:

1. In a twin-wire paper machine, an endless carrier wire and an endless pressure wire respectively extending along separate closed loops and having coextensive common run portions between which a web is compressed during formation thereof while traveling from an inlet end of said common run portions to an outlet end thereof, said carrier wire carrying the web beyond said outlet end of said common run portions, forming roll means situated within the loop of said carrier wire at said inlet end of said common run portions, a pair of guide rolls respectively situated within said loops and respectively engaging said wires in advance of said inlet end for directing said wires toward said inlet end respectively along converging paths which define between themselves an entrance region to said inlet end where said forming roll means is located, elongated forming board means situated in one of said loops and engaging one of said wires between said inlet end and the guide roll which engages said one wire, said forming board means having next to said one wire a wall formed with dewatering openings, headbox means situated at least partly at said entrance region and having a pair of lips which define between themselves a slice through which said headbox means directs a stock jet toward said one wire and said forming board means which engages the same, said headbox means being situated at a distance sufficiently great from said inlet end of said common run portions for depositing the stock jet on said one wire at a location in advance of said inlet end by a distance sufficient to enable orientation of fibers of said stock to be determined by the cooperation of said headbox means and said one wire and the dewatering openings in said wall of said forming board means, said headbox means, at least one of said lips thereof, and the combination of said forming board means and the guide roll which engages said one wire respectively forming three units at least one of which is adjustable for adjusting the angle of said jet with respect to said one wire, and adjusting means operatively connected with said one unit for adjusting the same to determine said angle, so that by way of said adjusting means it is possible to control the orientation of the fibers on the part of the web which forms on said one wire in advance of said inlet end.

2. The combination of claim 1 wherein said headbox means is said one unit which is adjustable by said adjusting means.

3. The combination of claim 2 and wherein said pressure wire is said one wire which is engaged by said forming board means so that said headbox means is adjustable by said adjusting means with respect to said pressure wire and said forming board means engaging the same.

4. The combination of claim 2 and wherein said carrier wire is said one wire which is engaged by said forming board means and with respect to which said headbox means is adjusted by said adjusting means for determining said angle.

5. The combination of claim 1 and wherein a pair of said forming board means are respectively situated in said loops engaging said wires between said pair of guide rolls and said inlet end of said common run portions, and a pair of said headbox means situtated at least partly at said entrance region for respectively directing a pair of said jets respectively toward said wires and said pair of forming board means engaging the same, both of said headbox means forming said adjustable units for determining the angles of said jets with respect to said wires, and said adjusting means being operatively connected to both of said headbox means.

6. The combination of claim 1 and wherein the combination of said forming board means and said guide roll which engages said one wire forms said one unit which is adjustable by said adjusting means for determining said angle.

7. The combination of claim 1 and wherein said one of said lips forms said adjustable unit which is adjusted by said adjusting means for determining said angle.

8. The combination of claim 1 and wherein an adjusting means is operatively connected with at least one of said guide rolls for adjusting the position thereof and for thus adjusting the angle between said converging paths to determine the angle of said entrance region to said inlet end of said common run portions.

9. The combination of claim 8 and wherein the combination of said forming board means and guide roll forms said one unit which is adjusted by the adjusting means which is operatively connected to said one unit for determining the angle of said jet, and the latter adjusting means being the same adjusting means which is operatively connected to said one guide roll for determining the angle of said entrance region.

10. The combination of claim 9 and wherein a connecting means connects said forming board means and said one guide roll to each other for adjustable movement together as a unit for adjusting both the angle of said jet and the angle of said entrance region.

11. The combination of claim 1 and wherein said carrier wire has a coarser mesh than said pressure wire.

12. The combination of claim 1 and wherein said lips include one lip which is more distant from said one wire than the other lip, and said one lip being adjustable with respect to said other lip and said adjusting means being operatively connected to said one lip for adjusting the latter to determine said angle of said jet, so that said one lip forms said adjustable unit.

13. The combination of claim 1 and wherein said forming board means has the construction of a suction box having next to said one wire a wall formed with said openings which communicate with the interior of said suction box, and suction means operatively connected with the interior of said suction box for creating suction therein to enhance dewatering.

14. In a method of operating a twin-wire paper machine which has endless carrier and pressure wires respectively extending along separate closed loops while having coextensive common run portions between which a web is compressed during formation thereof while travelling from an inlet end to an outlet end of said common run portions, with a pair of guide rolls being situated in said loops in advance of said inlet end for directing the wires respectively along converging paths which define between themselves an entrance region to said inlet end, while a forming board means is situated in one of the loops and has a wall, formed with dewatering openings, engaging one of the wires between said inlet end and the guide roll which engages said one wire, with a headbox means being situated at least partly at the entrance region and having a pair of lips defining between themselves a slice through which the headbox means directs a stock jet toward said one wire and the forming board means which engages the same, said headbox means, at least one of said lips thereof, and the combination of said forming board means and the guide roll which engages said one wire respectively forming three units, comprising the step of adjusting at least one of said units for determining the angle of said jet with respect to said one wire, while depositing said jet on said one wire at a distance sufficiently in advance of said inlet end to determine the orientation of fibers in the web which forms on said one wire in advance of said inlet end prior to reaching said inlet end.

15. In a method as recited in claim 14 and wherein said headbox means is the unit which is adjusted.

16. In a method as recited in claim 14 and wherein said one lip of said headbox means is the unit which is adjusted.

17. In a method as recited in claim 14 and wherein the combination of said forming board means and the guide roll which engages said one wire is the unit which is adjusted.

18. In a method as recited in claim 14 and wherein the machine has a pair of forming board means respectively engaging said wires between said guide rolls and said inlet end of said common run portions and a pair of headbox means for respectively directing stock jets toward said wires and the forming board means which respectively engage the same, and comprising the step of adjusting both of said headbox means with respect to said wires for respectively determining the angles of both jets with respect to said wires.

19. In a method as recited in claim 14 and wherein a forming roll is situated in the closed loop formed by said carrier wire at said inlet end of said common run portions with dewatering taking place primarily due to centrifugal force outwardly away from the forming roll, and including the step of situating the forming board in engagement with the carrier wire in advance of the forming roll while applying suction through the latter forming board to compensate in advance of the forming roll for the dewatering taking place at the forming roll.

20. In a method as recited in claim 14 and wherein a forming roll is situated in the closed loop formed by said carrier wire at said inlet end of said common run portions with suction being provided in the interior of the forming roll for providing dewatering primarily through the carrier wire into the interior of the forming roll, and situating the forming board means in engagement with the pressure wire in advance of the forming roll while providing suction through the latter forming board means to compensate for the suction in the opposite direction at the forming roll subsequent to the forming board means.

* * * * *